United States Patent [19]

Kirkpatrick

[11] Patent Number: 4,899,652

[45] Date of Patent: Feb. 13, 1990

[54] KEY STAMP

[76] Inventor: Michael A. Kirkpatrick, P.O. Box 66524, Seattle, Wash. 98166

[21] Appl. No.: 176,530

[22] Filed: Apr. 1, 1988

[51] Int. Cl.[4] ..... B41F 17/00

[52] U.S. Cl. ..... 101/4; 101/474

[58] Field of Search ..... 101/28, 29, 3.1, 4, 101/391, 381, 368, 474; 400/132, 129, 128, 127; 269/219, 269, 1

[56] References Cited

U.S. PATENT DOCUMENTS

| | | | |
|---|---|---|---|
| 1,948,911 | 2/1934 | Gardner, Jr. | 101/474 X |
| 2,002,847 | 5/1935 | Atti | 101/28 X |
| 2,142,009 | 12/1938 | Siebert | 400/132 |
| 2,565,608 | 8/1951 | Hoff | 101/3.1 |
| 2,813,559 | 11/1957 | Kennedy | 269/269 X |
| 4,437,400 | 3/1984 | Ellis | 101/4 X |

*Primary Examiner*—Clifford D. Crowder
*Attorney, Agent, or Firm*—Ward Brown; Robert W. Beach

[57] ABSTRACT

An elongated base block of hard metal material has a flat upper surface to act as an anvil for a key resting on such surface. A narrow key-clamping rail extends lengthwise of the anvil and thumbscrews at its opposite ends may be turned to clamp the key. A die for debossing indicia in the key can be positioned vertically by holding it against a vertical surface of the rail. Alternatively, a die can be positioned in an upright guide slot of a carriage or saddle movable along the rail and sized to closely receive the die. By maintaining the die with its length precisely perpendicular to the upper surface of the anvil and, consequently, the key, a uniform impression in the key is assured when the die is struck.

14 Claims, 1 Drawing Sheet

Fig. 1.
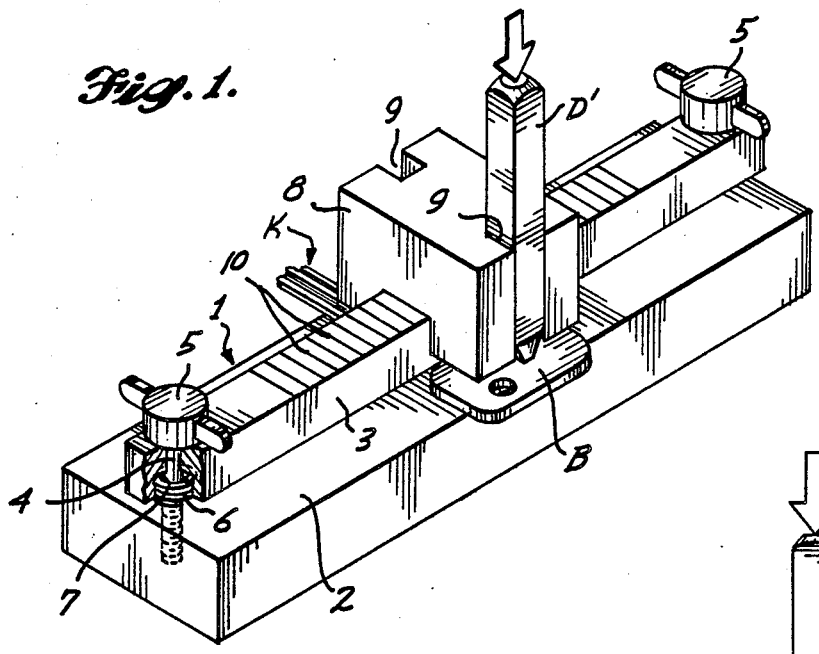
Fig. 2.
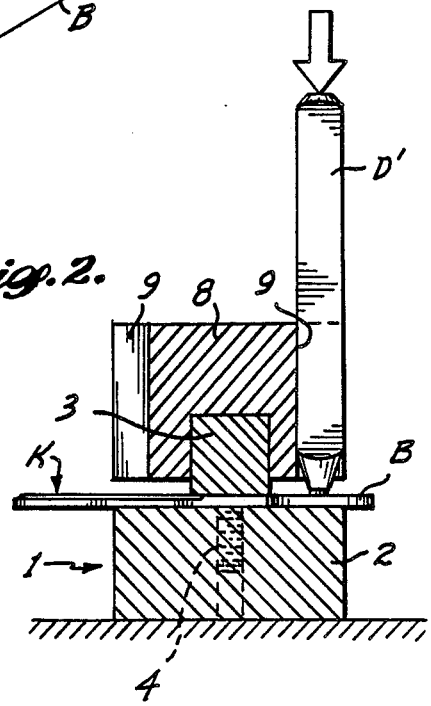
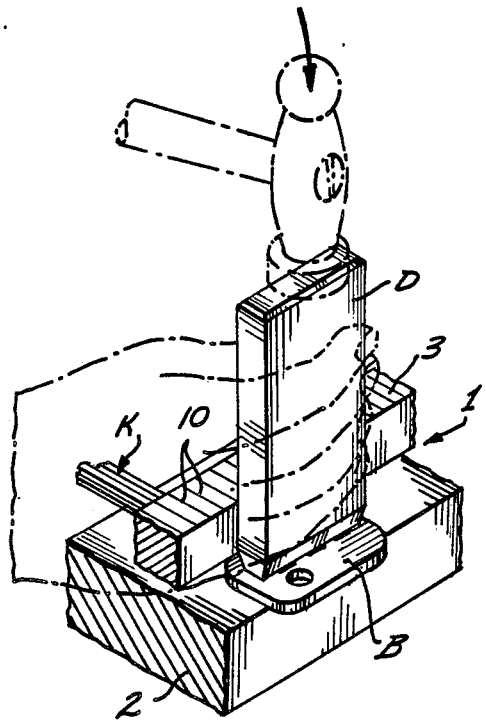
Fig. 3.

KEY STAMP

BACKGROUND OF THE INVENTION

1. Field of the Invention

The present invention relates to an anvil and a clamp for a key and an associated guide for a die used to deboss or impress one or more letters, numbers or other identifying or descriptive indicia in the bow of the key.

2. Prior Art

There are complicated and expensive machines for impressing identifying or descriptive indicia on keys, but most locksmiths use standard dies which are positioned and struck manually. If a die is not held with its length precisely perpendicular to the face of the bow, the impression is uneven. In addition, if one or more lines of characters are desired, it is difficult to align the characters precisely and to space the characters evenly.

SUMMARY OF THE INVENTION

The principal object of the present invention is to provide a device useful for debossing indicia on keys which device is of simple, compact and inexpensive but durable construction, and easy to use by skilled locksmiths and apprentices or inexperienced novices.

In the preferred embodiment of the present invention, the foregoing object is accomplished by providing an anvil with an elongated flat upper surface for supporting the key to be debossed, a clamping rail extending lengthwise of the anvil above the key with mechanism for moving the rail downward to clamp the key while leaving its bow exposed and engaged against the anvil, and a saddle slidable lengthwise of the rail and having at least one upright guide slot proportioned to receive a standard die with the length of the die extending perpendicular to the exposed bow face. The rail can have evenly spaced markings to assist the user in moving the saddle in uniform increments for adjacent characters. The saddle can be reversible on the rail with guide slots of different dimensions at opposite sides for different sizes of dies. For custom dies of large rectangular cross section, the saddle can be removed and a broad side of the die can be conveniently held manually against a side of the rail to position the die perpendicular to the bow face while the die is struck to deboss one or more lines of characters in the key.

BRIEF DESCRIPTION OF THE DRAWINGS

FIG. 1 is a somewhat diagrammatic top perspective of a key stamp in accordance with the present invention with parts broken away.

FIG. 2 is a somewhat diagrammatic end elevation of the key stamp of FIG. 1 with parts broken away.

FIG. 3 is a somewhat diagrammatic fragmentary top perspective of the key stamp of FIG. 1 with a part removed.

DETAILED DESCRIPTION

The key stamp in accordance with the present invention is used with standard dies of the type used by locksmiths to deboss indicia in the bow of a key. Standard dies are provided in sets, each elongated die having the same cross-sectional size and shape, usually approximately square. Each die has a pointed end with a character in relief and a blunt end which is struck to deboss the character in a flat face of the key bow. A custom die can be much wider than it is thick with one or more lines of characters on a somewhat pointed end of the broad die. For either standard dies with individual characters or custom dies with several characters, conventionally the key is placed on a hard surface acting as an anvil and the die is held and struck manually to make an impression. Even craftsmen skilled in other areas of the locksmith trade can have difficulty holding the die with its length precisely perpendicular to the key face which is required to make impressions of uniform depth. The key stamp in accordance with the present invention reliably holds the key on which indicia is to be debossed and assists in maintaining each die with its length perpendicular to the key face for an even impression.

As shown in the drawings, the novel key stamp 1 in accordance with the present invention includes an elongated base block 2 of hard metal material having a flat upper surface to act as an anvil. An elongated key-clamping rail 3 extends lengthwise over the anvil. Such rail is centered between the opposite sides of the anvil. The opposite end portions of the rail have upright holes for the shanks 4 of thumbscrews 5. The externally threaded bottom portion of each shank 4 is screwed into a threaded upright hole in the corresponding end portion of the anvil. A helical compression spring 6 encircles the central portion of the thumbscrew shank 4 with the bottom end of the spring engaged against the upper surface of the anvil. The upper portion of the spring is received in a short bottom counterbore 7 of the rail to bias the rail upward away from the anvil.

With the thumbscrews loosened to provide sufficient clearance between the rail 3 and anvil 2, a key K to be debossed is inserted beneath the rail with the section of the key bow B in which the indicia are desired exposed but resting on the anvil alongside the rail. The thumbscrews are tightened to move the rail downward against the force of the compression springs 6 and thereby securely clamp the key in position.

With reference to FIG. 3, with the key clamped in position, a die D can be held with one broad face flush against the upright side of rail 3 adjacent to the key bow B while being struck. Consequently, as thus far described, the key stamp in accordance with the present invention constitutes a substantial improvement over the conventional manual debossing system, particularly for a custom elongated die having one or more lines of characters. Nevertheless, for smaller square dies having a single character, there still is some chance that the die will slip and be canted more or less sideways, i.e., in a vertical plane parallel to the length of the rail 3, in which case an uneven impression would be made.

With reference to FIGS. 1 and 2, for a smaller square die D' having only a single character, a carriage or saddle 8 can be supported on the rail 3. Such saddle has a downward-opening groove centered between the opposite sides of the saddle and of a width only slightly greater than the width of the rail 3. As best seen in FIG. 2, the depth of the bottom groove is only slightly less than the height of the rail to position the bottom face of the saddle no lower than the bottom of the rail and preferably slightly above the bottom of the rail. The saddle is freely slidable along the length of the rail and may be removed by simply lifting it from the rail, such as to permit manual debossing by use of a broader custom die as illustrated in FIG. 3.

As seen in FIG. 1, the saddle 8 has a vertical guide slot 9 at each opposite side extending alongside the rail over the anvil. Each slot is of a cross section complemental to the cross section of a standard die. In FIG. 1, the slot nearer the viewer in which the die D' is positioned accommodates a standard 5/16 inch (0.79 cm) die, whereas the slot at the opposite side accommodates a standard ¼ inch (0.64 cm) die. With the die fitted in a slot as seen in FIGS. 1 and 2, the outer face of the die is approximately flush with the upright outer face of the saddle, although the slot could be somewhat shallower. The primary consideration is that the die fit fairly closely in the slot to maintain the die with its length precisely vertical. The outer side of the die can be exposed for grasping by the user while the die is positioned by movement of the saddle and while the die is struck.

To assist in debossing a row of evenly spaced characters, the upper surface of the rail can be inscribed to have uniformly spaced markings 10, with or without reference numbers, for gauging the relative position of the saddle 8 as it is moved lengthwise of the rail 3. Dies of different sizes can be used for a row of characters by reversing the position of the saddle on the rail without unclamping the key. Preferably, the length of the anvil and rail between the thumbscrews is at least several times the width of a standard key bow such that a row of keys of identical blanks can be clamped simultaneously for more convenient embossing of a plurality of keys.

After the debossing operation, the key can be removed quickly and easily by simply unscrewing the thumbscrews a short distance and sliding the key out from beneath the rail.

Since all components are made of strong metal material, the composite key stamp is of sufficient weight as to rest in one position reliably without undue slipping and sliding.

I claim:

1. For use with a key and an elongated die for debossing indicia in the key, a key stamp comprising an anvil having a surface for engaging against the key, means for maintaining the key substantially stationary relative to said anvil by clamping the key to said anvil, said clamping means including an elongated rail and means for moving said rail toward and away from said anvil, and a carriage mounted for movement relative to said anvil, said carriage having a guide slot for closely receiving the die to position it with its length at a desired angle relative to the key, said carriage being mounted for movement along said rail.

2. The key stamp defined in claim 1, in which the rail-moving means includes screw means having a shank extending through the rail and received in the anvil and means for biasing the rail away from the anvil.

3. The key stamp defined in claim 2, in which the biasing means includes a helical compression spring encircling the screw means shank and having opposite ends engaged, respectively, against the rail and the anvil.

4. The key stamp defined in claim 1, in which the carriage is in the form of a saddle having a groove opening at the exterior thereof for closely receiving the rail and permitting free sliding movement of said saddle lengthwise along the rail.

5. The key stamp defined in claim 4, in which the saddle is detachable by manual translation away from the rail.

6. The key stamp defined in claim 4, in which the saddle has at least two guide grooves for accommodating dies of different cross-sectional size.

7. The key stamp defined in claim 4, in which the saddle has two guide grooves for accommodating dies of different cross-sectional size and positioned at opposite sides of the rail, respectively, when the saddle is mounted on the rail.

8. The key stamp defined in claim 4, in which the rail has uniformly spaced markings for gauging the relative position of the saddle along the rail.

9. For use with a key and an elongated die for debossing indicia in the key, a key stamp comprising an elongated base block having a flat upper surface forming an anvil, an elongated rail of a width much narrower than the width of said elongated base block, means mounting said rail over said base block for movement toward and away from said upper surface thereof to clamp and release a key positioned between said rail and said block, a saddle slidable along said rail and having an upright guide groove offset from said rail but aligned with said upper surface of said base block and sized to receive the die closely and position it with its length substantially perpendicular to said upper surface of said base block.

10. The key stamp defined in claim 9, in which the rail mounting means includes two screw means extending through the rail at the opposite end portions thereof and turnable manually to move the rail relative to the base block.

11. For use with a key and an elongated die for debossing indicia in the key, a key stamp comprising an anvil having a surface for engaging against the key, means for maintaining the key substantially stationary relative to said anvil, a horizontally elongated rail extending alongside said anvil, and a saddle having a groove of a depth less than the upright dimension of said rail and opening at the bottom thereof for closely receiving the rail and permitting free sliding movement of said saddle lengthwise along said rail, said saddle having a guide slot for closely receiving the die to position it with its length at a desired angle relative to the key such that said saddle is detachable from said rail by manual translation away from said rail and said anvil.

12. The key stamp defined in claim 11, in which saddle has at least two guide grooves for accommodating dies of different cross-sectional size.

13. The key stamp defined in claim 11, in which the saddle has two guide grooves for accommodating dies of different cross-sectional size and positioned at opposite sides of the rail, respectively, when the saddle is mounted on the rail.

14. For use with a key and an elongated die for debossing indicia in the key, a key stamp comprising an anvil having a surface for engaging against the key, means for maintaining the key substantially stationary relative to said anvil, an elongated rail extending alongside said anvil, and a saddle having a groove opening at the exterior thereof for closely receiving the rail and permitting free sliding movement of said saddle lengthwise along said rail, said saddle having two separate guide slots for closely receiving dies of different cross-sectional size and positioned at opposite sides of said rail, respectively, when said saddle is mounted on said rail for positioning a selected die with its length at a desired angle relative to the key.

* * * * *